US008711542B2

(12) United States Patent
Fellinger

(10) Patent No.: US 8,711,542 B2
(45) Date of Patent: Apr. 29, 2014

(54) SYSTEMS AND METHODS FOR DISSIPATING AN ELECTRIC CHARGE WHILE INSULATING A STRUCTURE

(75) Inventor: Thomas John Fellinger, Littleton, CO (US)

(73) Assignee: Johns Manville, Denver, CO (US)

( * ) Notice: Subject to any disclaimer, the term of this patent is extended or adjusted under 35 U.S.C. 154(b) by 208 days.

(21) Appl. No.: 13/309,649

(22) Filed: Dec. 2, 2011

(65) Prior Publication Data

US 2013/0141832 A1 Jun. 6, 2013

(51) Int. Cl.
*H05F 3/02* (2006.01)

(52) U.S. Cl.
USPC ..... 361/220; 52/742.13; 52/404.1; 406/124; 406/128

(58) Field of Classification Search
USPC ..... 361/220; 52/223.6, 404.2, 404.3, 407.3, 52/443, 445, 742.1, 742.13
See application file for complete search history.

(56) References Cited

U.S. PATENT DOCUMENTS 5,819,496 A * 10/1998 Sperber ..... 52/742.13
6,503,026 B1 * 1/2003 Mitchell ..... 406/128
7,279,021 B2 * 10/2007 Haberlein ..... 55/360

* cited by examiner

*Primary Examiner* — Jared Fureman
*Assistant Examiner* — Kevin J Comber
(74) *Attorney, Agent, or Firm* — Robert D. Touslec

(57) ABSTRACT

Embodiments of the invention provide methods and systems for insulating a cavity of a structure. A system may include an insulation machine having an insulation blower that blows insulation into the cavity and a hose having a lumen throughwhich the loose fill insulation is blown. The system may also include a cover positionable atop the cavity of the structure. The cover may include an aperture throughwhich the distal end of the hose is inserted to blow the loose fill insulation into the cavity and an electrically conductive material or layer. The electrically conductive material or layer may electrically contact the hose when the hose is inserted through the aperture. The system may further include a ground wire electrically coupled with the cover to dissipate a charge from the hose by providing an electric path for the charge.

23 Claims, 6 Drawing Sheets

SYSTEMS AND METHODS FOR DISSIPATING AN ELECTRIC CHARGE WHILE INSULATING A STRUCTURE

BACKGROUND OF THE INVENTION

The present invention relates generally to methods and systems for dissipating a charge during an insulation process, and more specifically to methods and systems for dissipating a charge while applying loose fill insulation to a cavity of a structure.

Loose fill insulation materials, such as fiber glass, rockwool, and the like are often blown into attics, walls, and the like of homes and/or buildings to insulate the home and/or building. The insulation fill process often involves blowing the loose fill insulation materials through a plastic hose. As the loose fill insulation is blown through the hose, a static charge often develops on the insulation material and on the hose. To minimize static charge buildup, antistatic agents may be applied to the loose fill insulation, and/or water may be added to the loose fill insulation, while in the hopper of a blowing machine. In areas where the relative humidity is less than about 30%, the effectiveness of antistatic agents may be reduced or may not work at all because the antistatic materials generally function by extracting water molecules from the surrounding environment. To reduce static buildup under low humidity conditions, water is typically added to the loose fill insulation. A problem with adding water to the loose fill insulation is that the insulation may remain wet for prolonged periods of time and the installed density of the insulation may be altered. As a result, too little or too much insulation may be installed versus a desired amount. The addition of water to the loose fill insulation may additionally result in poor insulation performance, moisture damage to adjacent components, damage to electric components, increased installation cost, and the like.

As such, there is a need for improved methods and systems for reducing static charge buildup associated with installing loose fill installation within a home and/or building.

BRIEF SUMMARY OF THE INVENTION

Embodiments of the invention provide methods, systems, and devices for insulating a cavity. In one aspect, embodiments of the invention include a method for insulating a cavity. The method may include providing a blowing machine configured to blow loose fill insulation material into a cavity of a structure. The method may also include providing a hose having a proximal end, a distal end, and a lumen throughwhich the loose fill insulation material is blown. The proximal end of the hose may be connected to the blowing machine so that the loose fill insulation may be blown through the hose. The method may further include positioning a cover atop the cavity of the structure, the cover being electrically conductive and having at least one aperture. The method may additionally include connecting a ground wire to the cover and inserting the distal end of the hose through the aperture of the cover. The method may additionally include operating the blowing machine to blow the loose fill insulation material into the cavity and dissipating a charge from the hose via the electrically conductive cover and ground wire. The charge may be generated as the loose fill insulation material is blown through the hose.

In some embodiments, the distal end of the hose may include an electrically conductive material and the method may additionally include connecting a second ground wire to the distal end of the hose so as to dissipate a charge from the distal end of the hose. In some embodiments, the electrically conductive material of the distal end of the hose may include a metallic tubing positioned over the distal end of the hose. In other embodiments, the hose may include and/or be composed of metallic tubing.

In some embodiments, the method may additionally include positioning an electrically conductive material on one side of the cover so that the cover comprises an electrically conductive layer. In some embodiments, the cover may include a plurality of apertures spaced or positioned with respect to the cover so that the apertures span an opening of the cavity when the cover is positioned atop the cavity and the method may additionally include: blowing a first amount of loose fill insulation material into the cavity through the aperture, withdrawing the distal end of the hose from the aperture, inserting the distal end of the hose through an additional aperture, and blowing a second amount of loose fill insulation material into the cavity through the additional aperture.

The method may additionally include connecting an opposite end of the ground wire to an electrically conductive column of a building or a ground spike. The method may additionally include dissipating a second charge from the cavity of the structure via the electrically conductive cover and ground wire, the second charge being generated as the loose fill insulation material is blown into the cavity. In some embodiments, positioning the cover atop the cavity of the structure may include positioning the cover atop a cavity of a spa or a wall of a manufactured home.

In another aspect, embodiments of the invention include an apparatus for dissipating a charge during application of loose fill insulation to a cavity of a structure. The apparatus may include a cover positionable atop a cavity of a structure to be filled with the loose fill insulation. The cover may have a plurality of apertures throughwhich a distal end of an insulation hose may be positioned to blow loose fill insulation into the cavity of the structure. The apparatus may also include an electrically conductive material positioned on one side of the cover. The electrically conductive material may contact the insulation hose when the insulation hose is positioned through the aperture and the electrically conductive material may be electrically coupled with a ground wire to dissipate a charge from the insulation hose by providing an electric path or grounding path for the charge. The charge may be generated as the loose fill insulation is blown through the insulation hose.

In some embodiments, the cover may be configured to fit atop a cavity of a spa. In other embodiments, the cover may be configured to fit atop a cavity of a manufactured home wall. In some embodiments, one or more of the plurality of apertures of the cover may be spaced on opposite sides of a stud of the manufactured home wall.

In another aspect, embodiments of the invention include a system for dissipating a charge during application of loose fill insulation to a cavity of a structure. The system may include an insulation application machine, a cover, and a ground wire. The insulation application machine may include an insulation blower configured to blow the loose fill insulation into the cavity of the structure and may also include a hose having a proximal end, a distal end, and a lumen throughwhich the loose fill insulation is blown, the proximal end of the hose being coupled with the insulation blower. The cover may be positionable atop the cavity of the structure and may include one or more apertures throughwhich the distal end of the hose is positioned to blow the loose fill insulation into the cavity and an electrically conductive material that contacts the hose when the distal end hose is positioned through the aperture. The ground wire may be electrically coupled with the cover so as to dissipate a charge from the hose by providing an electric path or grounding path for the charge. The dissipated charge may be generated as the loose fill insulation is blown through the hose.

In some embodiments, the hose may include an electrically conductive material and a second ground wire may be electrically coupled with the hose to dissipate a charge from the hose by providing a second electric or grounding path for the charge. In some embodiments, the hose may include a metallic tubing positioned over the distal end of the hose and the second ground wire may be electrically coupled with the metallic tubing.

In some embodiments, the cover may include an electrically conductive layer of material positioned on one side of the cover and/or may include a second electrically conductive layer of material positioned on an opposite side of the cover. The system may also include a grounding member electrically coupled with the ground wire, which in some embodiments may include an electrically conductive column of a building or a ground spike. The cover may also be configured to dissipate a second charge from the cavity of the structure. The second charge may be generated as the loose fill insulation material is blown within the cavity.

In another aspect, embodiments of the invention include a method for insulating a cavity. The method may include: providing a blowing machine configured to blow loose fill insulation into a cavity of a structure; providing a hose having a proximal end, a distal end, and a lumen throughwhich the loose fill insulation is blown, the hose having an electrically conductive distal end; connecting the proximal end of the hose to the blowing machine; connecting a ground wire to the electrically conductive distal end; operating the blowing machine to blow the loose fill insulation into the cavity, and dissipating a charge from the hose via the ground wire, the charge being generated as the loose fill insulation material is blown through the hose.

In some embodiments, the method may also include: positioning a cover over the cavity, the cover comprising an electrically conductive material or layer and at least one aperture; connecting a second ground wire to the cover so that the electrically conductive material or layer is electrically coupled with the second ground wire; and inserting the electrically conductive distal end of the hose through the aperture so that the electrically conductive distal end of the hose contacts the electrically conductive material or layer of the cover to dissipate the charge that is generated as the loose fill insulation material is blown through the hose.

BRIEF DESCRIPTION OF THE DRAWINGS

Embodiments of the present invention are described in conjunction with the appended figures.

Figure 1A:
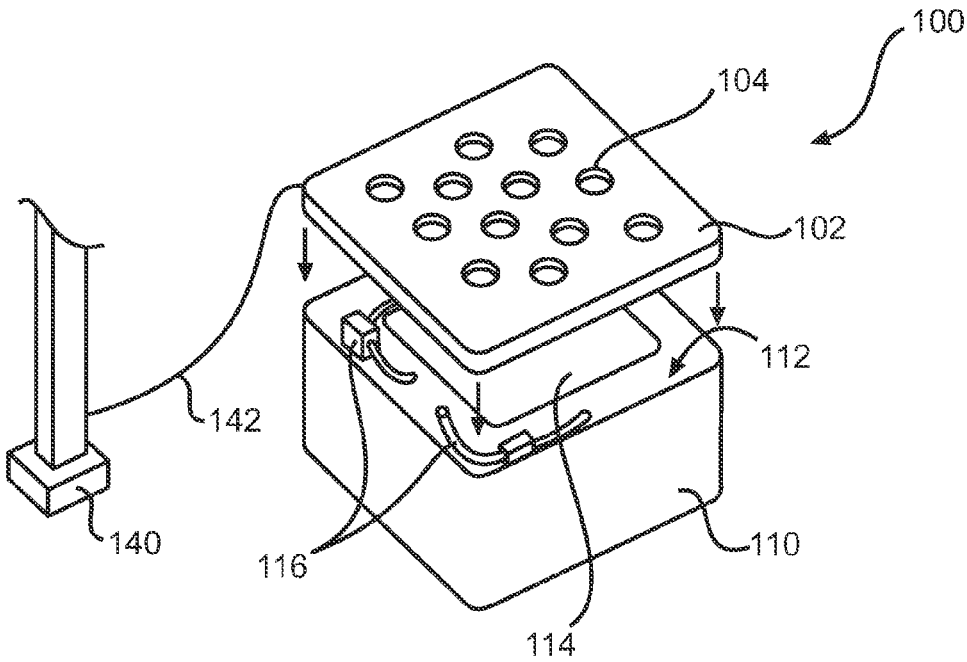
FIGS. 1A-1B illustrate embodiments of a cover used in insulation fill processes, the cover being positioned atop various structures.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the embodiments will provide those skilled in the art with an enabling description for implementing one or more embodiments. It being understood that various changes may be made in the function and arrangement of elements without departing from the spirit and scope of the invention as set forth in the appended claims. Specific details are given in the following description to provide a thorough understanding of the embodiments. However, it will be understood by one of ordinary skill in the art that the embodiments may be practiced without these specific details. Also, it is noted that methods or processes may be depicted as a flowchart or a block diagram. Although a flowchart may describe the operations as a sequential process, many of the operations can be performed in parallel or concurrently. In addition, the order of the operations may be re-arranged. Further a process could have additional steps not discussed or included in a figure. Furthermore, not all operations in any particularly described process may occur in all embodiments.

As used herein, the term spa may refer to any tub or pool (large or small) that may be filled with water and/or another liquid. Spas are typically heated and used for soaking, relaxing, hydrotherapy, and the like and may be indoors or outdoors. Spas are also often referred to as hot tubs. Spas are often made of wood or plastic materials that may include one or more pieces. Plastic spas are often made via vacuum forming or rotational molding although other manufacturing methods are possible. Spas may also have one or more jets that are used for injecting water or air, massaging, and/or general relaxation. Although the term spa is used primarily herein, it should be realized that the systems and methods described are equally applicable to applying loose fill insulation in other structures, such as appliances, components of manufactured homes, wall, floors, attics, and the like of pre-existing or on-site built homes or buildings.

As used herein, the term loose fill insulation may refer to any insulation material that is loosely positioned or filled in a cavity of a structure, such as in a wall or attic of a home. Loose fill insulation is typically blown into the cavity through a hose connected to a blowing machine (e.g., a pneumatic blowing machine). The blowing machine is often loaded with an insulation material and then used to separate the insulation material into individual segments or pieces, which are then blown through the hose. Loose fill insulation materials may include fiber glass, rockwool, cellulose, slag wool, nodulized or shredded cellular plastics (foam), loose-fill areogel, shredded cotton, granular and/or powdered insulation materials, powdered additives to insulation, shredded polyester batting, and the like. The loose fill insulation may be applied into the cavity to a specified depth and/or density to provide a desired R value or may be applied to a depth defined by the cavity, such as when being blown into walls and other structures.

As used herein, the term prefabricated or manufactured building or home may refer to any building that consists of one or more factory-built components or units. The prefabricated building or home may be assembled at the factory and shipped to a job site or assembled on-site to construct the building or home. For example, a prefabricated home may consist of several components that are built in a factory for assembly with other components, either at the factory or on-site, to construct the home. The components may include walls, floors, an attic or roof, and the like. Fabricating or building the walls, floors, roof, etc. may include installing plumbing, electrical, lighting, network connections, insulation, and the like in the walls, floors, roofs, etc. Specific examples of such prefabricated buildings are modules (modular homes), transportable section homes (manufactured homes), mobile homes, and the like, although the term may also refer to single components or panels that may be shipped to a job site and coupled with one or more other components or panels.

As used herein, the term ground wire may refer to any wire that may carry electrical currents to a base point, such as the ground or Earth. The ground wire provides a low resistance common return path for an electric current and may include a direct physical connection to the Earth or to a structure connected to the Earth, such as an electrically conductive beam of a building and/or ground spike. Similarly, the term ground spike may refer to any rod (or set of rods) driven into the soil or Earth to form a grounding contact for the ground wire. Although the term "ground spike" may be used herein, it should be realized that an electrically conductive structure of a building may function as a ground spike and may be used instead of or in addition to a ground spike. Ground wires and ground spikes may be made of any electrically conductive material, such as copper, aluminum, iron, steel, and the like.

In one aspect, embodiments of the invention provide an electrically conductive cover that may be used during a loose fill insulation process to dissipate static charges from an insulation hose and/or structure being filled with loose fill insulation. The electrically conductive cover, which may be a generally planar member, may be positioned atop a cavity of the structure to be filled with the loose fill insulation. The cover includes apertures throughwhich the insulation hose, or a nozzle of the insulation hose, is inserted to blow the loose fill insulation into the cavity. The cover may be made of an electrically conductive material or otherwise includes an electrically conductive material layer or coating. The electrically conductive material/layer contacts the insulation hose when the hose is inserted through the aperture so as to receive or capture a static charge therefrom. A ground wire is electrically coupled with the cover (e.g., electrically coupled with the electrically conductive layer) to provide an electric path that may dissipate static charges that build up on the insulation hose. Such static charges may build up as the loose fill insulation is blown through the hose. The ground wire and electrically conductive cover may also dissipate static charges that build up on the structure as the loose fill insulation is blown into and/or circulated within the cavity.

Along with an insulation application machine, the electrically conductive cover may be part of a system for dissipating a charge during a loose fill insulation process. Insulation application machines typically include a loose fill insulation blower that blows loose fill insulation into the cavity of the structure. The loose fill insulation blower is connected to an insulation hose having a loose fill insulation delivery lumen throughwhich the loose fill insulation is blown into the cavity.

In another aspect, embodiments of the invention provide for an electrically conductive insulation hose. The electrically conductive insulation hose may include an insulation delivery lumen throughwhich loose fill insulation is blown via an insulation blower. In some embodiments, the electrically conductive insulation hose may be made of an electrically conductive material (e.g., copper tubing, aluminum tubing, and the like). In other embodiments, the electrically conductive insulation hose may include an electrically conductive sheath or nozzle near a distal end of the hose. A ground wire may be connected to the electrically conductive insulation hose or electrically conductive nozzle/sheath. An opposite end of the ground wire may be connected to an electrically conductive column or ground spike to provide an electric path that dissipates static charges that build up on the electrically conductive insulation hose. As described above, static charges may build up on the electrically conductive insulation hose as the loose fill insulation is blown therethrough. The electrically conductive insulation hose may be used to apply loose fill insulation into a cavity of a structure, such as a wall of a building, an attic of a home (either manufactured home, site built, preexisting, and the like), an appliance, a spa, and the like.

The electrically conductive cover may be used with the electrically conductive insulation hose to dissipate static charges that build up on the insulation hose and/or structure being filled with insulation. The insulation hose and cover may be electrically coupled with the same ground wire and/or ground, or may be electrically coupled with different ground wires and/or grounds. The combination of the electrically conductive insulation hose and electrically conductive cover may provide multiple electric paths that may dissipate static charges.

As described herein, embodiments of the invention provide means for eliminating the buildup of static electricity during an insulation filling process. This creates a safe working environment for the installer because the installer does not need to be concerned with static discharge, which may shock the installer, pose a fire hazard if flammable components/fluids are nearby, and the like. Further, embodiments of the invention may eliminate or reduce the need to apply water and/or an antistatic agent to the insulation material being blown into a cavity of a structure. This may eliminate or reduce potential moisture related damage (e.g., moisture damage to adjacent structures, such as wooden studs, electrical components, and the like) and/or moisture related performance concerns (e.g., poor insulation R value, increased or decreased insulation density, and the like) due to the addition of water to control static charges. This may be a particular advantage in drier (i.e., low humidity) climates. The cover described herein may provide for substantially uniform and essentially void free insulation fills within cavities of various structures. Further, the cover may be reusable in subsequent insulation fill processes and/or may be used with various different structures, such as spas, appliances, manufactured home components, and the like. Additional aspects of embodiments of the invention will be evident with reference to the figures.

Figure 1B:
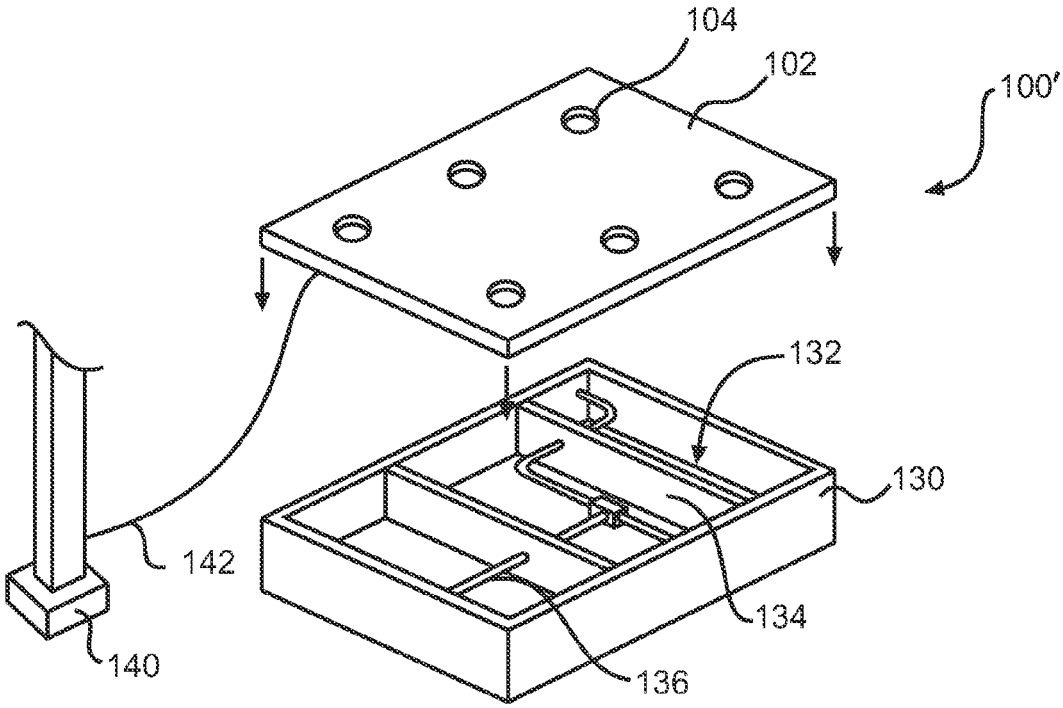

FIGS. 1A and 1B illustrate planar members 100 and 100' that may be used to dissipate static charges that build up on insulation hoses and/or structures being insulated. Planar members 100 and 100' may be in the form of a cover 102 that is shaped and sized to fit atop a structure to be insulated, such as a spa 110 and/or a manufactured wall 130 of a manufactured home. Cover 102 includes a plurality of apertures 104 throughwhich an insulation hose (see FIGS. 2A-2B) is inserted. Loose fill insulation material (e.g., fiber glass, rockwool, and the like) is blown through the insulation hose and delivered within a cavity, 112 or 132, of the structure, 110 or 130 respectively. The plurality of apertures 104 allow the insulation hose to be positioned above one area or portion of the cavity, 112 or 132, so that loose fill insulation may be applied to that area. The insulation hose may then be repositioned through a different aperture 104 and positioned above a different area of the cavity, 112 or 132, and insulation applied to that area. The repositioning of the insulation hose with respect to the cavity, 112 or 132, allows insulation to be evenly or uniformly filled or applied throughout the cavity.

For example, in FIG. 1B, the plurality of apertures 104 are positioned on different sides of studs 134 so that insulation can be filled or applied within each cavity bordered by studs 134 and end pieces of the manufactured wall 130. FIG. 1B shows two apertures 104 positioned within the boundaries of each of three cavities 132, although more or less apertures 104 may be positioned within the cavity boundaries. Manufactured wall 130 is also shown being prefabricated with one or more structures 136 extending through cavity 132. Prefabricated structures 136 may include pipes, plumbing, vents, electrical conduits, electrical outlets, fixtures, control boxes, and the like. Such structures are often prefabricated in manufactured homes. Apertures 104 allow loose fill insulation to be evenly and uniformly applied around structures 136, or in other words, the multiple apertures 104 ensure that structures 136 do not block the loose fill insulation being blown into the cavities.

Similarly, in FIG. 1A, the plurality of apertures 104 are positioned around and/or over a raised portion 114 of spa 110. The raised portion 114 represents the tub of the spa 110 in which individuals sit or rest. The tub is raised because spa 110 is flipped upside down so that the insulation is applied to the bottom portion of the spa 110 around the tub. Since apertures 104 are positioned around raised portion 114, insulation may be evenly applied and uniformly filled within cavity 112 around raised portion 114. Spa 110 is also shown including one or more structure 116 positioned around raised portion 114. Structures 116 may include heaters, filters, blowers, water or air jets, control boxes, pumps, and the like, which are common components of spas. Apertures 104 allow loose fill insulation to be evenly and uniformly applied around structures 116.

In some embodiments, cover 102 is made of an electrically conductive material. For example, cover 102 may be a copper or aluminum sheet or plate or may include such materials. In another embodiment, cover 102 includes an electrically conductive coating or layer positioned on one or both sides of cover 102 (see FIG. 3A-3C). The electrically conductive coating or layer may include a foil, metal screen, metalized cloth, a grid or mesh of grounding wire, metal coating, welded steel grid, perforated metal sheet, and the like. In some embodiments, the electrically conductive layer includes virtually any cover made of metal. One end of a ground wire 142 is electrically coupled to the electrically conductive cover 102 and/or electrically conductive layer/coating of cover 102. An opposite end of ground wire 142 is electrically coupled with a ground 140, which may include an electrically conductive column of a home or building (e.g., a steel column), a ground spike, and the like. Ground 140 provides a low resistance common return path for an electric current or charge. The electrically conductive cover 102 and/or electrically conductive layer of cover 102 generally contacts an insulation hose inserted through apertures 104 such that the electrically conductive material, layer, and/or cover is able to capture or receive a static charge built up or otherwise existing on the insulation hose. Similarly, electrically conductive cover 102 and/or electrically conductive layer of cover 102 contact the structure, 110 and 130, such that the electrically conductive material, layer, and/or cover is able to capture or receive static charges built up or otherwise existing on the structure. In other words, static charges are transferred to the electrically conductive cover 102 or layer/coating from the hose and/or structure. Ground 140 and ground wire 142 dissipate static charges captured or otherwise received by cover 102. In this manner, static charges may be dissipated from the insulation hose and/or structure being insulated thereby eliminating or greatly reducing the problems associated with such static charges (e.g., electric discharge, fire hazard, insulation moisture problems, and the like). Likewise, static charges generated during the insulation fill process will be quickly and efficiently dissipated.

Cover 102 may also include a lip or flange (not shown) that extends vertically downward and that fits over and/or around an outer periphery of the structure (e.g., 110 or 130) being insulated. The lip or flange may prevent the cover 102 from sliding off the structure or from substantially moving with respect thereto during the insulation fill process.

Figure 2A:
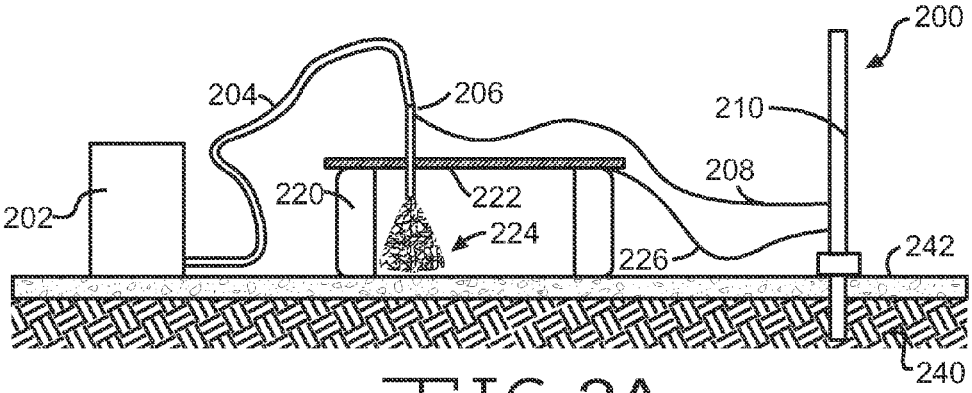
FIGS. 2A-2B illustrate embodiments of a system for dissipating static charges during an insulation fill process.
Figure 2B:
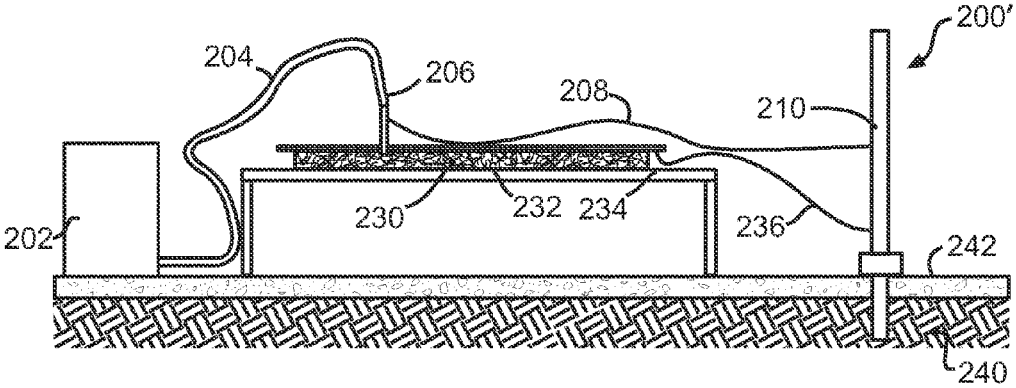

Referring now to FIGS. 2A-2B, illustrated are systems, 200 and 200', that dissipate static charges during an insulation fill process. As described herein, static charges may be generated as loose fill insulation is blown through an insulation hose and into a cavity of a structure.

System 200 includes cover 222 positioned over a structure, which may be a spa 220. Cover 222 includes a plurality of apertures (not shown) throughwhich an insulation hose 204 is inserted to blow insulation material 224 within a cavity or cavities of spa 220. Cover 222 includes an electrically conductive material, coating, and/or layer that captures or receives a static charge from insulation hose 204 and/or from spa 220. Cover 222 is electrically coupled with one end of a ground wire 226. The other end of ground wire 226 is electrically coupled with a ground 210, which may be an electrically conductive column of a building, a ground spike, and the like. Ground 210 in turn is connected to floor 242 (e.g., concrete floor) and/or Earth 240. Cover 222 and ground 226 facilitate in dissipating static charges from insulation hose 204 and/or spa 220. Such static charges may be generated within insulation hose 204 as loose fill insulation is blown through a lumen of insulation hose 204. Static charges may likewise be generated within the cavity of spa 220 as loose fill insulation is blown within the cavity and/or circulated within the cavity. Rubbing contact between an inner surface of the insulation hose 204 lumen and the loose fill insulation being blown through the lumen may generate or transfer such static charges, for example, due to electron exchange between contacting materials. Likewise, rubbing contact between an inner surface of spa 220 cavity and the loose fill insulation being blown into the cavity may generate or transfer static charges.

Similarly, System 200' includes cover 232 positioned over a different structure, which may be a manufactured home component 230 (e.g., a wall, attic, floor, and the like). Cover 232 includes a plurality of apertures (not shown) throughwhich insulation hose 204 is inserted to blow insulation material within a cavity or cavities of component 230. Cover 232 includes an electrically conductive material, coating, and/or layer that captures or receives a static charge from insulation hose 204 and/or from component 230. Cover 232 is electrically coupled with one end of a ground wire 236. The other end of ground wire 236 is electrically coupled with a ground 210 (e.g., column, a ground spike, and the like). Ground 210 is connected to a floor 242 and/or Earth 240. Cover 232 and ground 236 facilitate in dissipating static charges from insulation hose 204 and/or component 230. Such static charges may be generated as described above. Component 230 may be positioned atop a work bench 234 in performing the insulation fill process and/or other processes.

Systems, 200 and 200', also includes an insulation blower 202 configured to blow loose fill insulation into the cavity of the structures. Blower 202 may be a pneumatic blowing machine. One end of insulation hose 204 is connected to blower 202 so that the loose fill insulation is blown from blower 202 and into the cavity through the lumen of insulation hose 204. The opposite end of insulation hose 204 is inserted within one of the apertures (not shown) of covers, 222 or 232, and loose fill insulation is blown into that portion of the cavity corresponding to the aperture throughwhich insulation hose 204 is inserted. To insulate another portion of the cavity, or another cavity, insulation hose 204 is withdrawn from the aperture and inserted within another aperture. During this process, static charges that build up on insulation hose 204 and/or the structure, 220 or 230, are transferred to the cover, 222 or 232 respectively, and dissipated via ground wire, 226 or 236, and ground 210.

In some embodiments, insulation hose 204 is made of or includes an electrically conductive material, such as copper tubing, aluminum tubing, steel tubing, and the like. The electrically conductive insulation hose 204 may be electrically coupled with a ground wire 208 that is in turn electrically coupled with ground 210. Static charges may be dissipated from the electrically conductive insulation hose 204 via ground wire 208 and ground 210.

Alternatively or additionally, insulation hose 204 may include an electrically conductive nozzle or sheath 206 positioned at or over the distal end of the hose. The electrically conductive nozzle or sheath 206 may be copper tubing, aluminum tubing, steel tubing, and the like. Nozzle or sheath 206 may be inserted within the apertures of the cover, 222 or 232 and may be electrically coupled with ground wire 208 that is electrically coupled with ground 210. Static charges may be transferred from insulation hose 204 to the electrically conductive nozzle or sheath 206 and dissipated via ground wire 208 and ground 210. In such embodiments, systems, 200 and 200', provide multiple low resistance electric paths that may dissipate static charges. Such embodiments further reduce or eliminate any generated or preexisting static charges. The use of an electrically conductive sheath or nozzle 206 allows preexisting insulation hoses to be included in systems, 200 and 200', and/or allows static charges to be dissipated from preexisting insulation hoses that typically include poor conductive materials.

Figure 3A:
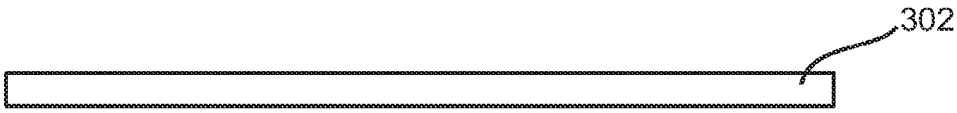
FIGS. 3A-3C illustrate embodiments of the cover of FIGS. 1A-1B showing the cover having various layers, which may be electrically conductive.
Figure 3B:
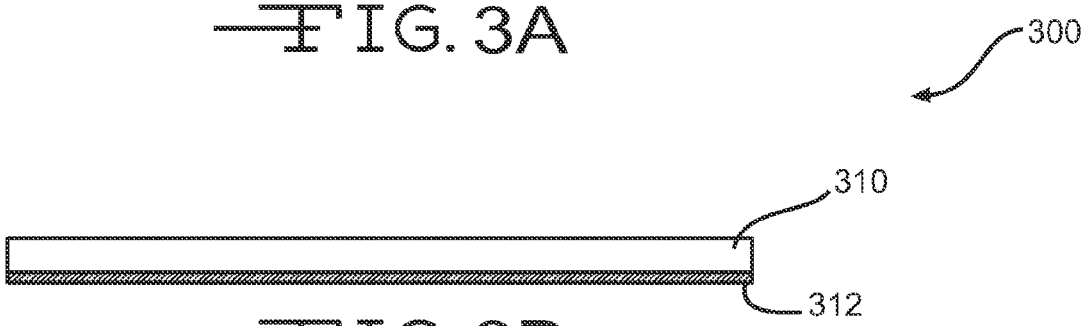
Figure 3C:
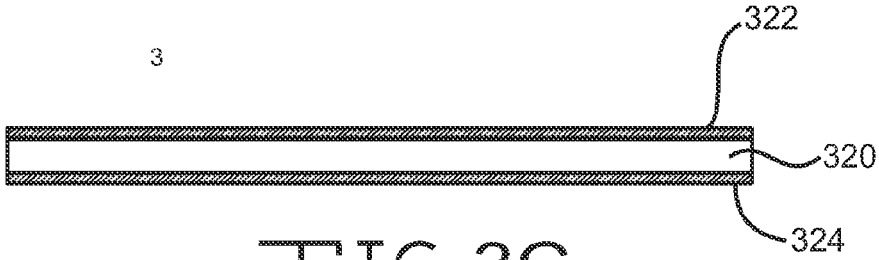

Referring now to FIGS. 3A-3C, illustrated are various embodiments of a cover designed to dissipate static charges during insulation fill processes. FIG. 3A illustrates a cover 302 having a single layer. Cover 302 includes an electrically conductive material, such as copper, aluminum, iron, steel, and the like. Cover 302 may be a solid sheet or plate of such material, or more commonly, may include such materials as a component or components of the cover. FIG. 3B illustrates a cover 310 having an electrically conductive coating or layer 312 positioned on one side of the cover. The electrically conductive coating or layer may include a foil, metal screen, metalized cloth, a grid or mesh of grounding wire, metal coating, and the like of conductive material. The conductive material may include copper, aluminum, iron, steel, and the like. FIG. 3C illustrates a cover 320 having an electrically conductive coating or layer 324 positioned on one side of the cover and an additional electrically conductive coating or layer 322 positioned on the opposite side of the cover. Similar to coating/layer 312, the electrically conductive coatings or layers, 324 and 322, may include a foil, metal screen, metalized cloth, a grid or mesh of grounding wire, metal coating, and the like of conductive material. The ground wire described herein may be electrically coupled with the electrically conductive cover and/or each of the electrically conductive coatings/layers.

Figure 4:
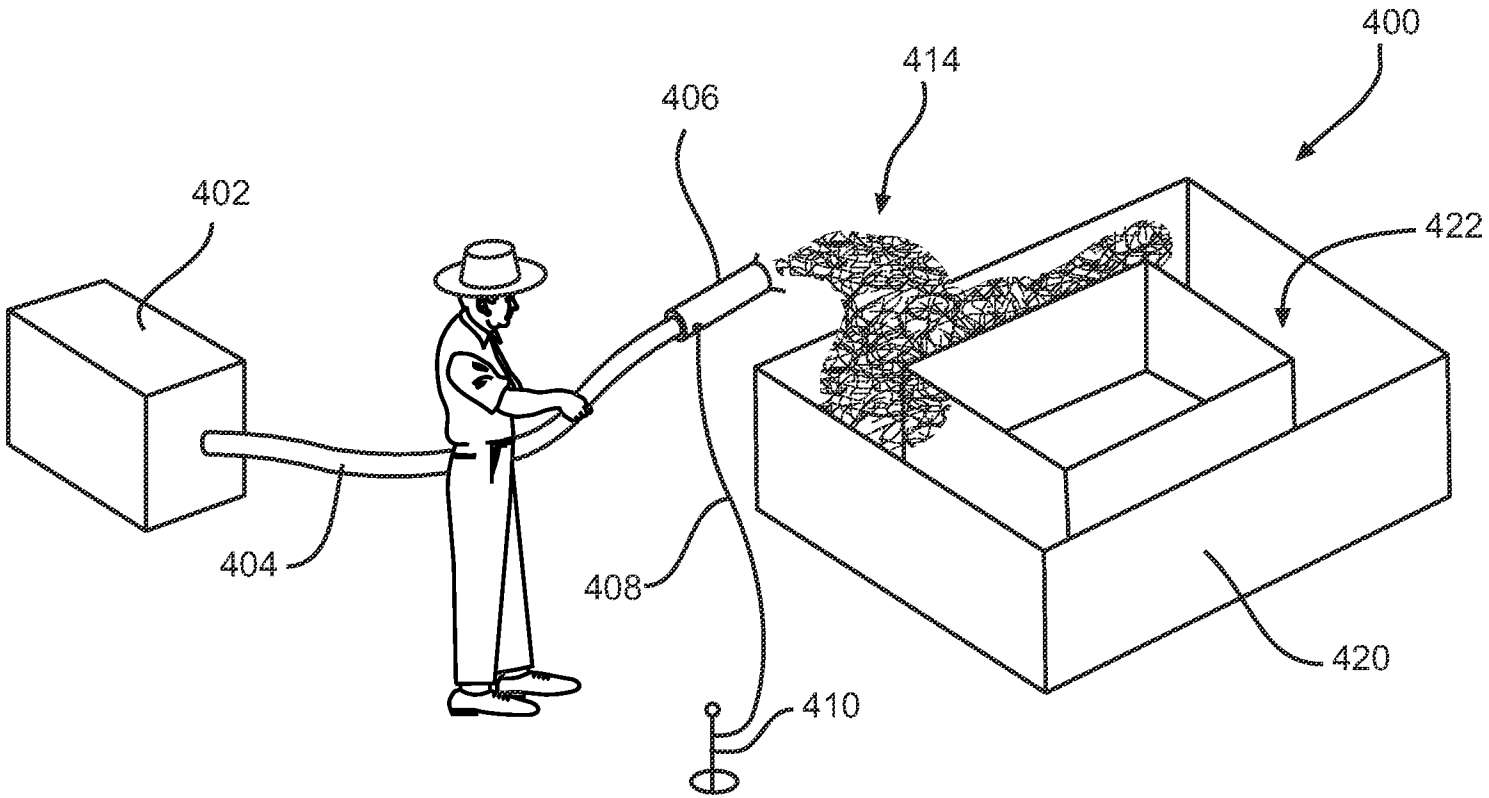
FIG. 4 illustrates an embodiment of an electrically conductive insulation hose being used to apply loose fill insulation to a structure.

Referring now to FIG. 4, illustrated is another embodiment of a system 400 for dissipating a static charge during an insulation fill process. System 400 includes an insulation blower 402 that blows loose fill insulation 414 through a lumen of insulation hose 404 into a cavity 422 (or cavities) of structure 420, which may be a spa, component of a manufactured home, appliance, and the like. In a specific embodiment, structure 420 may be an attic of a home, either pre-built or under construction and either built on-site or prefabricated. As described herein, static charges may be generated as the loose fill insulation 414 is blown through the lumen of insulation hose 404 and into cavity 422. As described above, insulation hose 404 may include an electrically conductive material (e.g., aluminum tubing) and may be electrically coupled with a ground wire 408, which is in turn electrically coupled with ground 410, to dissipate any generated static charges. Alternatively, insulation hose 404 may include an electrically conductive sheath or nozzle 406, which is electrically coupled with ground wire 408 and ground 410 to dissipate static charges. In this embodiment, static charges may be dissipated without the use of an electrically conductive cover. In other embodiments, an electrically conductive cover may be used and insulation hose 404 may be inserted through one or more apertures of the cover during the insulation fill process.

The embodiments described above are able to dissipate static charges from insulation hoses and/or structures being insulated with a loose fill insulation without requiring the application of an antistatic agent and/or water (i.e., moisture) to the loose fill insulation material. As such, the embodiments described above eliminate or greatly reduce moisture related problems associate with applying loose fill insulation, such as poor insulation performance, increased insulation density, moisture damage to structures (e.g., wooden beams, electrical equipment, and the like), and the like. Embodiments of the invention also eliminate or greatly reduce the hazard associated with static charges generated during the loose fill insulation process, such as electric discharge, shock, potential fire hazards, and the like.

Figure 5:
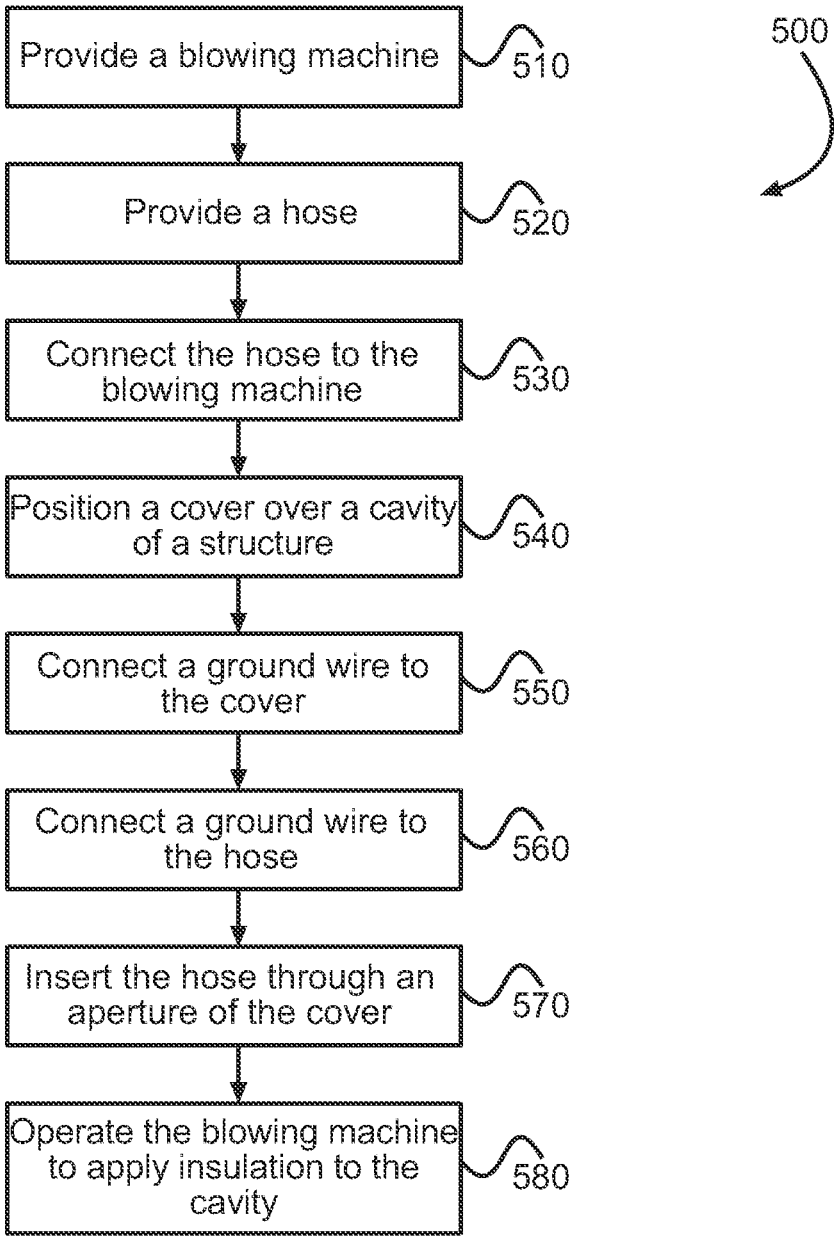
FIG. 5 illustrates an embodiment of a method for dissipating a static charge during an insulation fill process.

Referring now to FIG. 5, illustrated is a method 500 for insulating a cavity of a structure, according to an embodiment of the invention. At block 510, a blowing machine is provided. The blowing machine is configured to blow loose fill insulation material (e.g., fiber glass, rockwool, and the like) into the cavity of the structure. At block 520, a hose is provided. The hose may have a lumen extending between a proximal end and a distal end throughwhich the loose fill insulation is blown. Also, the hose may be electrically conductive (e.g., metallic tubing) or include an electrically conductive sheath or nozzle (e.g., metallic tubing sheath/nozzle) as described herein. At block 530, the proximal end of the hose is connected to the blowing machine. At block 540, a cover is positioned atop the cavity of the structure. The cover may be electrically conductive (e.g., may include an electrically conductive material, have one or more electrically conductive coatings/layers, and the like) and have at least one aperture as described herein.

At block 550, a ground wire may be electrically coupled or connected with the cover. At block 560, a ground wire (either the same ground wire connected to the cover or a different ground wire) may optionally be connected to the hose or a nozzle or sheath of the hose. At block 570, the hose is inserted through one of the apertures of the cover. At block 580, the blowing machine may be operated to apply (e.g., blow) the loose fill insulation in the cavity. The electrically conductive cover and ground wire may dissipate a charge from the hose. The charge may be a preexisting charge existing on the hose and/or may be generated as the loose fill insulation material is blown through the hose. The electrically conductive cover and ground wire may also dissipate an additional charge from the cavity of the structure. This charge may be a preexisting charge existing on the structure and/or may be generated within the cavity as the loose fill insulation material is blown into and/or circulated within the cavity.

The method 500 may also include blowing a first amount of loose fill insulation material into the cavity through the aperture of the cover, withdrawing the hose from the aperture, inserting the hose through an additional aperture of the cover, and blowing a second amount of loose fill insulation material into the cavity through the additional aperture. Such a process may allow a uniform and substantially even application of the loose fill insulation within the cavity. Positioning the cover atop the cavity of the structure may include positioning the cover atop a cavity of a spa or a wall of a manufactured home. The method may further include connecting an opposite end of the ground wire to an electrically conductive column of a building or a ground spike.

Figure 6:
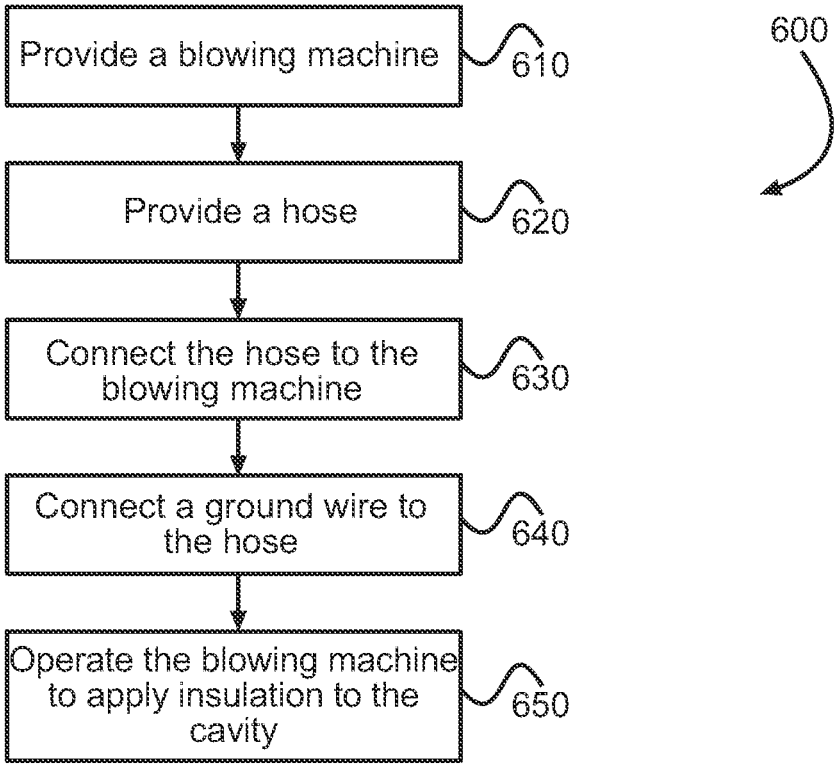
FIG. 6 illustrates another embodiment of a method for dissipating a static charge during an insulation fill process.

Referring now to FIG. 6, illustrated is another method 600 for insulating a cavity of a structure, according to another embodiment of the invention. At block 610, a blowing machine is provided that is configured to blow loose fill insulation into the cavity of the structure. At block 620, a hose is provided having a lumen extending between a proximal end and a distal end, throughwhich the loose fill insulation is blown. The hose is electrically conductive and/or has an electrically conductive distal end. At block 630, the proximal end of the hose is connected to the blowing machine. At block 640, a ground wire is connected to the electrically conductive distal end of the hose. At block 650, the blowing machine is operated to blow the loose fill insulation into the cavity. A static charge that is either preexisting on the hose and/or generated as the loose fill insulation material is blown through the hose is dissipated from the hose via the ground wire.

The method 600 may also include positioning a cover over the cavity of the structure. The cover may include at least one aperture and may be electrically conductive and/or include an electrically conductive coating or layer. A ground wire may be connected to the cover so that the electrically conductive cover, layer, and/or coating is electrically coupled with the ground wire. The ground wire may be the same ground wire connected to the hose or a different ground wire. The electrically conductive hose and/or the electrically conductive distal end of the hose may be inserted through an aperture of the cover so that the electrically conductive hose and/or electrically conductive distal end of the hose contacts the electrically conductive cover, layer, and/or coating to dissipate the static charge that is preexisting on the hose and/or generated as the loose fill insulation material is blown through the hose.

Although the electrically conductive covers (and methods) described herein have been generally described as being used to insulate spas and walls of manufactured homes, it should be realized that the electrically conductive covers may be used to insulate a variety of structures. For example, in some embodiments the electrically conductive covers (and methods) may be used to insulate various appliances, rail cars, walls of transportation trucks, storage tanks, pipes, and the like.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A method for insulating a cavity comprising:

providing a blowing machine configured to blow loose fill insulation material into a cavity of a structure;

providing a hose having a proximal end, a distal end, and a lumen throughwhich the loose fill insulation material is blown;

connecting the proximal end of the hose to the blowing machine;

positioning a cover atop the cavity of the structure, the cover being electrically conductive and having at least one aperture;

connecting a ground wire to the cover;

inserting the distal end of the hose through the aperture of the cover;

operating the blowing machine to blow the loose fill insulation material into the cavity; and dissipating a charge from the hose via the electrically conductive cover and ground wire, the charge being generated as the loose fill insulation material is blown through the hose.

2. The method of claim 1, wherein the distal end of the hose comprises an electrically conductive material, and wherein the method further comprises connecting a second ground wire to the distal end of the hose.

3. The method of claim 2, wherein the electrically conductive material comprises a metallic tubing positioned over the distal end of the hose.

4. The method of claim 2, wherein the hose comprises metallic tubing.

5. The method of claim 1, further comprising positioning an electrically conductive material on one side of the cover so that the cover comprises an electrically conductive layer.

6. The method of claim 1, wherein the cover comprises a plurality of apertures spaced across an opening of the cavity when the cover is positioned atop the cavity, and wherein the method further comprises:

blowing a first amount of loose fill insulation material into the cavity through the aperture;

withdrawing the distal end of the hose from the aperture;

inserting the distal end of the hose through an additional aperture; and blowing a second amount of loose fill insulation material into the cavity through the additional aperture.

7. The method of claim 1, wherein positioning the cover atop the cavity of the structure comprises positioning the cover atop a cavity of a spa or a wall of a manufactured home.

8. The method of claim 1, further comprising connecting an opposite end of the ground wire to an electrically conductive column of a building or a ground spike.

9. The method of claim 1, further comprising dissipating a second charge from the cavity of the structure via the electrically conductive cover and ground wire, the second charge being generated as the loose fill insulation material is blown into the cavity.

10. An apparatus for dissipating a charge during application of loose fill insulation to a cavity of a structure, the apparatus comprising:

a cover positionable atop a cavity of a structure to be filled with the loose fill insulation, the cover having a plurality of apertures throughwhich a distal end of an insulation hose is positioned to blow the loose fill insulation into the cavity of the structure; and an electrically conductive material positioned on one side of the cover, the electrically conductive material contacting the insulation hose when the insulation hose is positioned through the aperture, wherein the electrically conductive material is electrically coupled with a ground wire so as to dissipate a charge from the insulation hose by providing an electric path for the charge, the charge being generated as the loose fill insulation is blown through the insulation hose.

11. The apparatus of claim 10, wherein the cover is configured to fit atop a cavity of a spa.

12. The apparatus of claim 10, wherein the cover is configured to fit atop a cavity of a manufactured home wall.

13. The apparatus of claim 10, wherein the structure comprises one or more structures selected from the group consisting of:

a spa;

a component of a manufactured home;

an appliance;

a rail car;

a wall of a transportation vehicle;

a storage tank; and a pipe.

14. The apparatus of claim 12, wherein one or more of the plurality of apertures are spaced on opposite sides of a stud of the manufactured home wall.

15. A system for dissipating a charge during application of loose fill insulation to a cavity of a structure, the system comprising:

an insulation application machine comprising:

an insulation blower configured to blow the loose fill insulation into the cavity of the structure; and a hose having a proximal end, a distal end, and a lumen throughwhich the loose fill insulation is blown, the proximal end of the hose being coupled with the insulation blower;

a cover positionable atop the cavity of the structure, the cover comprising:

one or more apertures throughwhich the distal end of the hose is positioned to blow the loose fill insulation into the cavity, and an electrically conductive material, wherein the electrically conductive material contacts the hose when the hose is positioned through the aperture; and a ground wire electrically coupled with the cover so as to dissipate a charge from the hose by providing an electric path for the charge, the charge being generated as the loose fill insulation is blown through the hose.

16. The system of claim 15, wherein the hose comprises an electrically conductive material, and wherein a second ground wire is electrically coupled with the hose so as to dissipate the charge from the hose by providing a second electric path for the charge.

17. The system of claim 16, wherein the hose comprises a metallic tubing positioned over the distal end of the hose, and wherein the second ground wire is electrically coupled with the metallic tubing.

18. The system of claim 15, wherein the cover comprises an electrically conductive layer of material positioned on one side of the cover.

19. The system of claim 18, wherein the cover comprises a second electrically conductive layer of material positioned on an opposite side of the cover.

20. The system of claim 15, further comprising a grounding member electrically coupled with the ground wire.

21. The system of claim 20, wherein the grounding member comprising an electrically conductive column of a building or a ground spike.

22. The system of claim 15, wherein the cover is configured to dissipate a second charge from the cavity of the structure, the second charge being generated as the loose fill insulation material is blown within the cavity.

23. A method for insulating a cavity comprising:

providing a blowing machine configured to blow loose fill insulation into a cavity of a structure;

providing a hose having a proximal end, a distal end, and a lumen throughwhich the loose fill insulation is blown, the hose having an electrically conductive distal end;

connecting the proximal end of the hose to the blowing machine;

connecting a ground wire to the electrically conductive distal end;

operating the blowing machine to blow the loose fill insulation into the cavity;

dissipating a charge from the hose via the ground wire, the charge being generated as the loose fill insulation material is blown through the hose;

positioning a cover over the cavity, the cover comprising an electrically conductive material or layer and at least one aperture;

connecting a second ground wire to the cover so that the electrically conductive material or layer is electrically coupled with the second ground wire; and inserting the electrically conductive distal end of the hose through the aperture so that the electrically conductive distal end of the hose contacts the electrically conductive material or layer of the cover to dissipate the charge that is generated as the loose fill insulation material is blown through the hose.

* * * * *